United States Patent [19]

Dietrich

[11] 4,100,639

[45] Jul. 18, 1978

[54] METHODS OF AN APPARATUS FOR WRAPPING JACKETS AROUND BOOKS

[75] Inventor: Günter Dietrich, Hille, Germany

[73] Assignee: Rahdener Maschinenfabrik August Kolbus, Germany

[21] Appl. No.: 802,624

[22] Filed: Jun. 2, 1977

[30] Foreign Application Priority Data

May 6, 1976 [DE] Fed. Rep. of Germany ..... 2620047

[51] Int. Cl.[2] ..... B42C 11/02

[52] U.S. Cl. ..... 11/1 R; 11/4

[58] Field of Search ..... 11/1 R, 3, 4

[56] References Cited

U.S. PATENT DOCUMENTS 3,881,204 5/1975 Sato ..... 11/1 R 3,922,743 12/1975 Schuler et al. ..... 11/1 R

*Primary Examiner*—Willie G. Abercrombie

[57] ABSTRACT

Paper jackets are automatically applied to hard cover books in a manner which provides a good fit between the jacket and book and insures against the jacket folds slipping free of the book covers during or immediately subsequent to jacket application. The books are supported with the covers opened outwardly, a jacket sheet is draped over the spine of the book, the jacket material is urged downwardly simultaneously from both sides so as to tightly conform to the book and the opposite edge portions of the jacket sheet are folded around the front edges of the book covers while applying heat to thereby define jacket flaps which slide inwardly when the book covers are reclosed.

17 Claims, 7 Drawing Figures

METHODS OF AN APPARATUS FOR WRAPPING JACKETS AROUND BOOKS

BACKGROUND OF THE INVENTION:

(1) Field of the Invention

The present invention relates to the production of books and particularly to the automatic application of protective jackets to hard cover books. More specifically, this invention is directed to apparatus for wrapping paper-type jackets around books. Accordingly, the general objects of the present invention are to provide novel and improved methods and apparatus of such character.

(2) Description of the Prior Art

It is common practice to apply paper jackets to books prior to the shipment thereof from the printer to the retailer. Such jackets are printed in flat form, are subsequently wrapped around the book and are folded into the book cover. The application of jackets to printed books by hand is obviously not an economically feasible approach.

Prior art techniques for automatically applying jackets to books are exemplified by the disclosure of German Pat. No. 1,103,294. The referenced German specification describes a method in which books, with their spines facing downwardly, are placed upon unfolded jackets. The covers of the books are then opened outwardly, the "turn-ins" or flaps, comprising oppositely disposed edge portions of the jackets, are folded around the covers and the books are then reclosed. Jacketing machines which are designed to operate in accordance with this prior art method have provided less than satisfactory results. The unsatisfactory results are, at least in part, due to the stiffness and resiliency of the jacket materials which often cause reopening of the book covers which allows the jacket flaps to slip out. Should this happen, the expensive procedure of manual reinsertion of the jacket is necessary. The stiffness of the jacket material may also prevent the desired tight wrapping of the jacket around the book by pushing the cover away from the joint area. The latter problem is particularly prevalent with thick or laminated jacket materials and imparts an unsightly appearance to the book while also having an adverse effect upon subsequent processing and final handling.

It is to be noted that the prior art technique exemplified by German Pat. No. 1,103,294 also contemplates that the jackets be folded prior to being wrapped about the book with the fold conforming to the spacing, between opposite side edges, of the covers of the book. While this prefolding technique may result in reducing the resiliency of the flaps, it does not preclude the possibility of the fold slipping across an edge of the cover nor does it insure that the jacket will be wrapped tightly enough to substantially conform to the book. Such slippage and the inability to achieve tight wrapping may be attributable to unavoidable manufacturing tolerances for both the block and cover portions of the book. Restated, in many cases dimensional agreement between the required and often variable spacing between the folds of the jacket and adjustment of the folding devices cannot be insured.

An alternative prior art method of applying jackets to books is disclosed in German Pat. No. 958,107. In this alternative method the books are arranged with their spines facing upwardly and their covers opened to an angle of 90°. During the course of application, the jackets are turned about heated bars located underneath the covers; such heated bars projecting past the edge of the cover by a preset length which is dependent upon the slack in the cover required to permit the closing of the jacket-fitted book. Although the use of heat during the folding or creasing operation reduces the resiliency of the jacket material in the fold area, adjustments of the apparatus which will preclude the possibility of either loose wrapping or the slipping out of the folds caused by wrapping too tightly is not possible. These problems; i.e., either unduly loose or too tight a wrapping; will occur when the spacing between the heated bars does not rather accurately coincide with the distance between the edges of the book cover plus an allowance for manufacturing tolerances as required to permit closing of the book and achievement of a neat appearance.

SUMMARY OF THE INVENTION

The present invention overcomes the above-briefly discussed and other deficiencies and disadvantages of the prior art by providing a novel and improved method of applying jackets to books and apparatus for use in the practice of such method. In accordance with the practice of the invention, a relatively tight fit between the jacket and book is guaranteed.

In accordance with the preferred embodiment of the invention, prior to the wrapping of the jacket around the book, the covers are opened out from the book block to an angle of approximately 30°. Thereafter, the flaps of the jacket are heat-folded around the edges of the covers and the book is thereafter closed. Advantageously, the method of the present invention is performed in such a manner that the jacket is tightly pulled across the spine of the book simultaneously from both sides, held in this position and subsequently folded across the fore edges of the cover in the direction of the book block. Simultaneously with the folding, the region of the jacket along the edges of the cover is heated while the jacket is deflected upwardly in insure that the flaps will slide upwardly inside the covers when the covers are closed.

Apparatus in accordance with a preferred embodiment of the invention includes support rollers which hold the outwardly opened book covers at the desired angle and members which urge the jacket sheet in the direction of the edges of the cover from both sides and thereafter hold the thus tightly pulled jacket in position on the cover during the wrapping operation. The preferred apparatus further includes means for initially bending the jacket around the front edges of the cover and subsequently turning the flap portions of the jacket at least partially back upon the jacket defining sheet. The means for accomplishing this bending of the jacket around the edges of the cover further includes heating elements which are movable from a retracted position toward the front edges of the cover.

A principal attribute of the present invention is that it accomplishes direct folding of the jackets around the edges of the cover and eliminates the necessity of having to pre-set a constant length between jacket folds. This results in the reduction of the stresses in the folded areas of the jacket thereby enhancing the usable life of the jacket.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
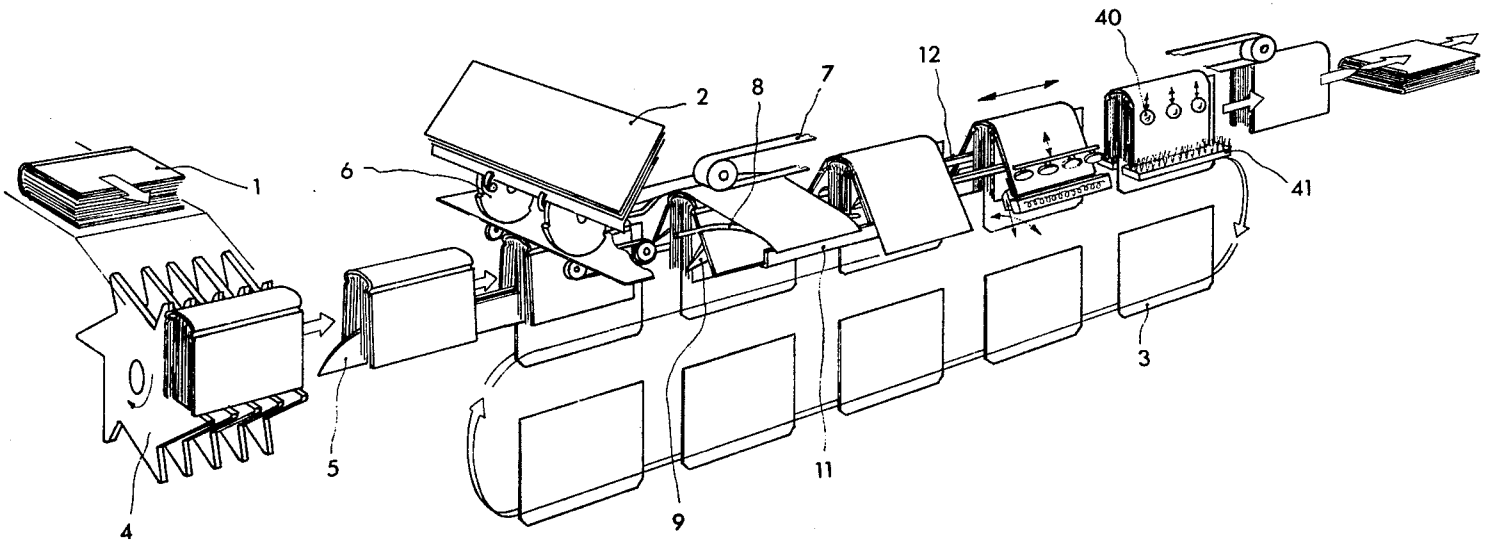
FIG. 1 is a schematic illustration of a jacket wrapping machine suitable for practicing a method in accordance with a preferred embodiment of the present invention.

Referring now to FIG. 1, the jacket wrapping machine shown schematically comprises a continuously circulating horizontal conveyor which receives and supports the books 1 to which paper jackets 2 are to be applied. In the manner to be briefly described below, during passage through the jacket wrapping machine the books will be supported on vertical plates 3 which are known in the art as gallows. The books 1 are delivered to the conveyor via a rotary feeder 4 and a block divider 5; the block divider opening the blocks whereby the books may be engaged by the gallows 3. The jackets 2 are individually applied to the spines of the books by means of a feeder mechanism 6. A hold down mechanism 7, which is shown in the form of an endless belt which moves in synchronism with the gallows on which the books are transported astraddle through the individual processing stations, urges the jackets 2 against the books 1. Guide members 8 initially support the sides of the jackets where they extend outwardly from the spines of the books. The apparatus of FIG. 1 is symmetrical whereby the application of the jackets to the books will take place simultaneously from both sides.

The covers of the books being delivered to the jacket wrapping machine are intially opened outwardly to an angle of approximately 30° by means of fins 9 and angle fillets 11. Subsequent to opening, as may best be seen from FIG. 2, the covers are supported on a linearly aligned row of adjacently mounted and freely rotating support rollers 10. While the present invention is not limited to a process in which the covers are opened to an angle of 30°, this angle has in practice been proven to uniformly result in the desired tight wrapping of the jackets on the book covers.

Figure 2:
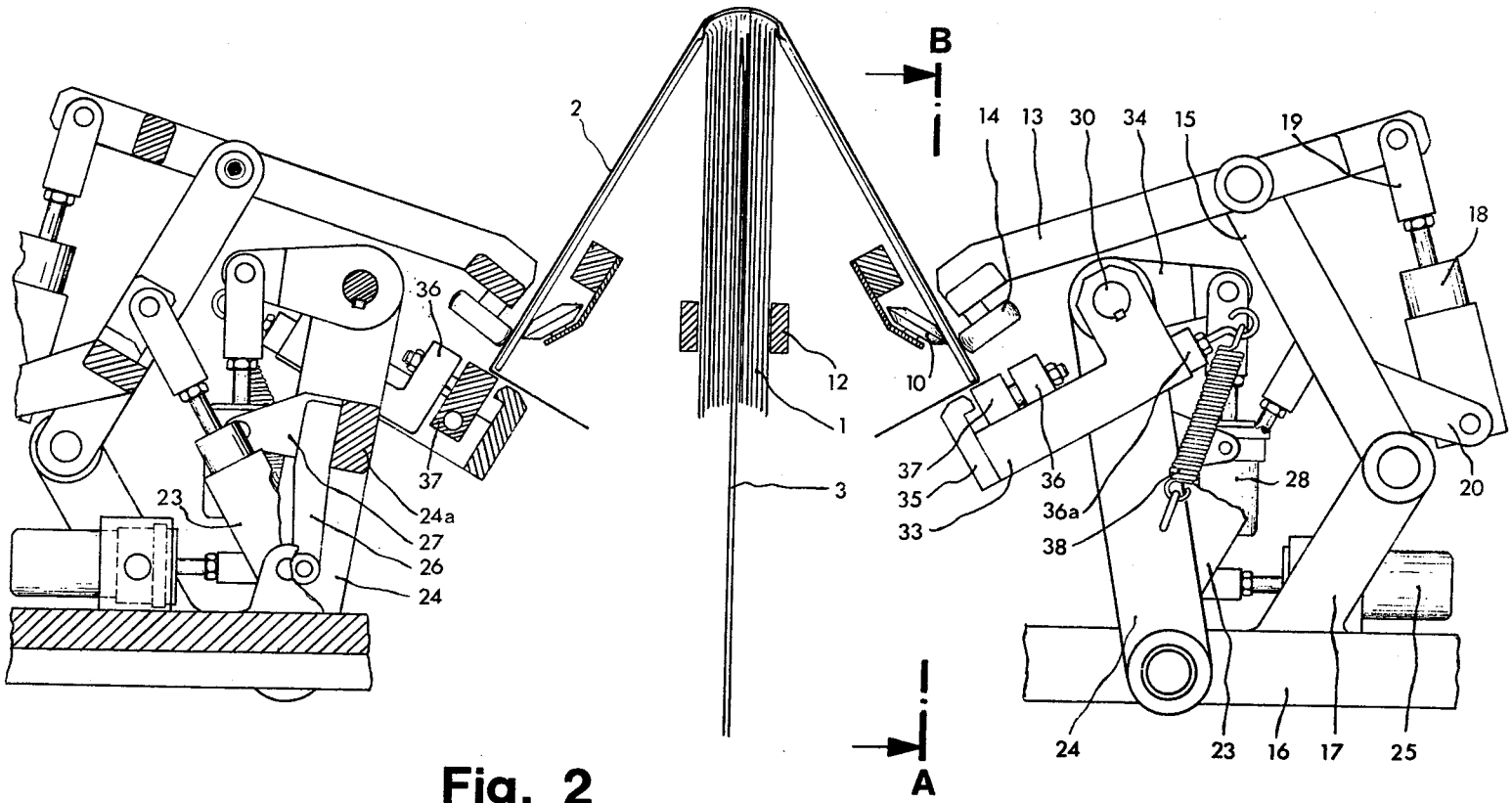
FIG. 2 is a front view, partially in section of a preferred embodiment of a wrapping station which may form part of the apparatus schematically depicted in FIG. 1.
Figure 3:
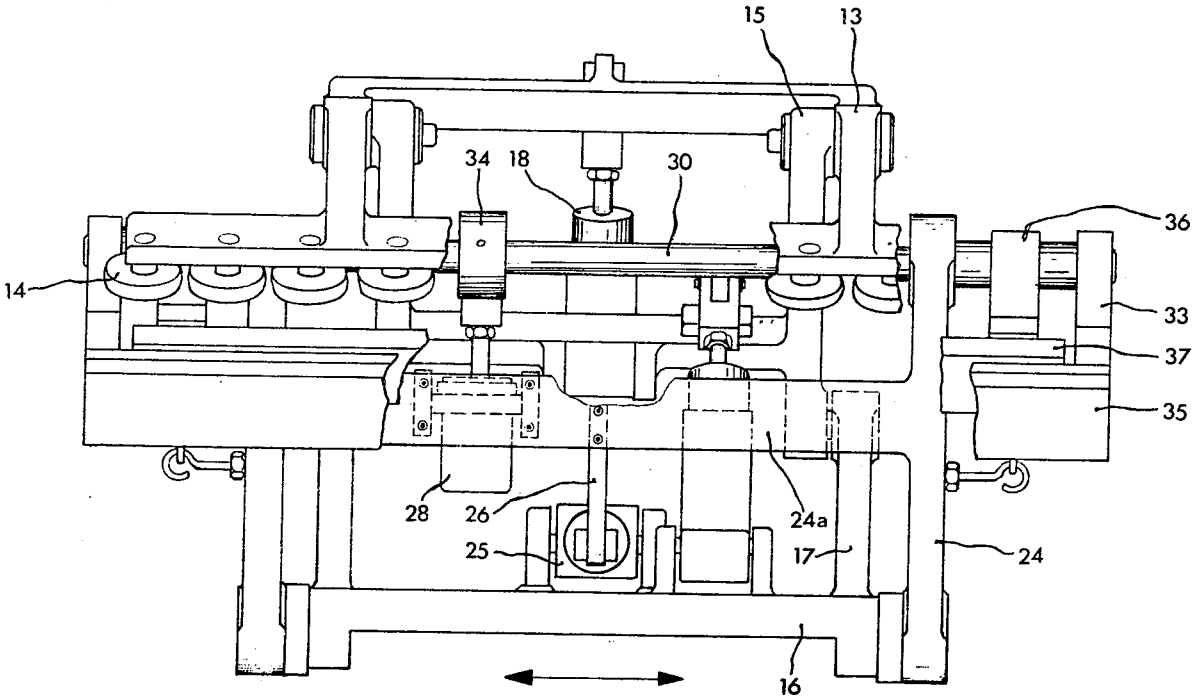
FIG. 3 is a cross-sectional side elevation view taken along line A–B of FIG. 2.
Figure 4:
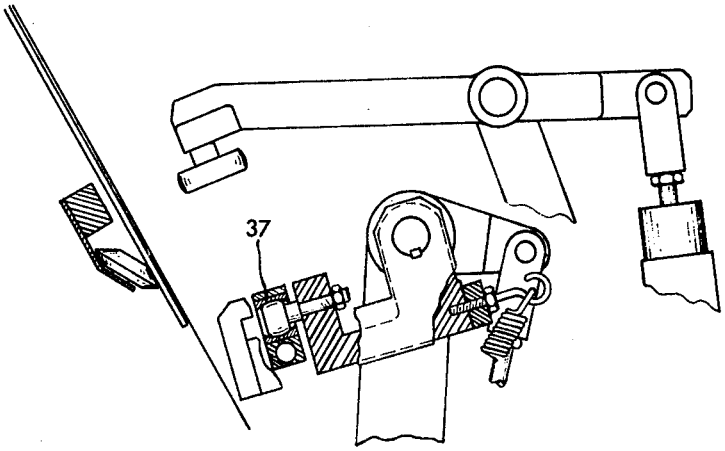
FIGS. 4–7 sequentially depict the jacket wrapping process as performed employing the apparatus of FIGS. 2 and 3.
Figure 5:
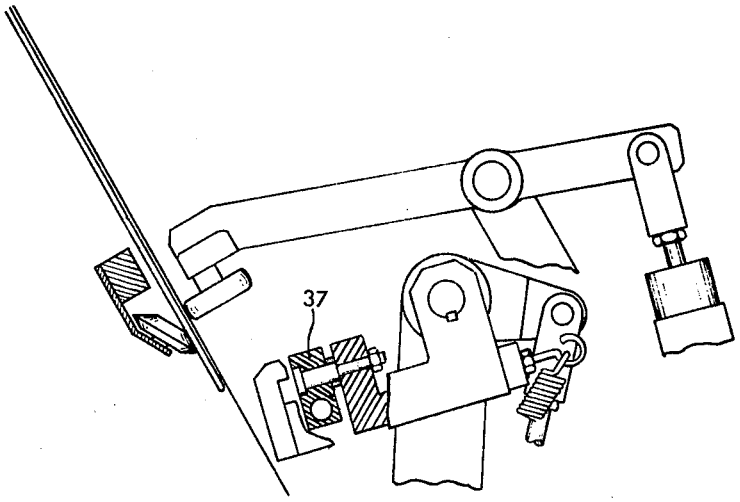
Figure 6:
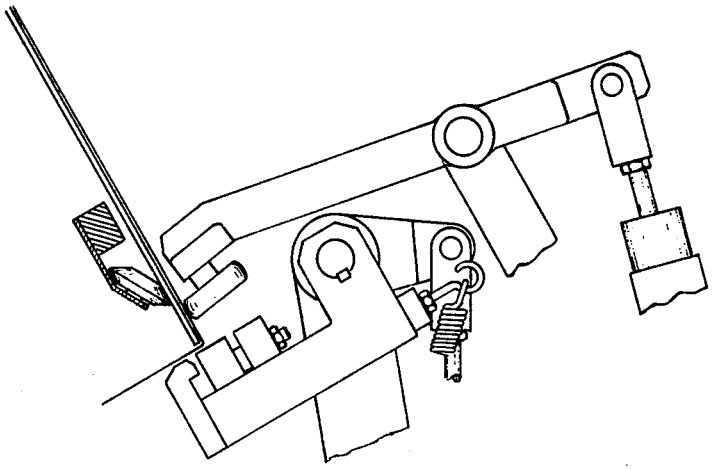
Figure 7:
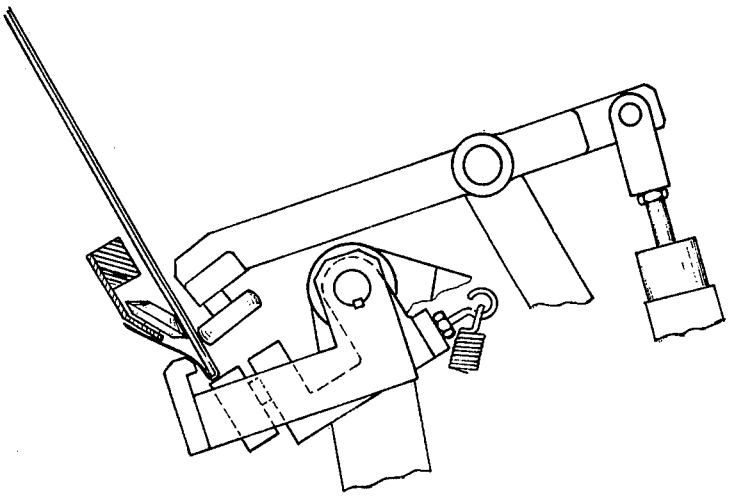

Continuing which a discussion of FIG. 2, and with simultaneous reference to all of FIGS. 3–7, the actual wrapping mechanism includes guide rails 12 which insure the book blocks a firm seat upon the gallows 3 as the books serially pass through the wrapping station. The mechanism of the wrapping station includes movable frames 13 which support, on first ends, freely rotating rubber rollers 14. Rollers 14, as may be seen from the sequential showing of FIGS. 4–6, contact the jacket and urge it, from both sides of the spine of the book, toward the edges of the cover. The rollers 14 also hold the tightly fitted jacket on the cover during the formation of the "fold-in" or flap. Frames 13 are mounted, intermediate their roller supporting ends, on the first end of respective further movable frames 15. The second ends of frames 15 are rotatably mounted in bearing brackets 17 which form an extension of longitudinally slidable carriages 16. The second end of each of frames 13 is engaged by the output shaft of a pneumatic actuator 18; actuators 18 being rotatably supported in transoms 20 carried by frames 15. The sliding carriages 16 are also coupled to frames 15, intermediate the ends of frames 15, by means of further pneumatic actuators 23. The motion sequence of one of frames 13, and thus rollers 14, is shown in FIGS. 4–6. Operating under control of actuators 18 and 23, the rollers 14 move up against the covers and then downwardly along the same to tighten the loosely applied jacket around the book spine and to thereafter hold the jacket in this forward position during the wrapping process. The frames 13 and 15 will, of course, return to their initial position as shown in FIG. 4 subsequent to the turning in of the jacket flaps as depicted in FIGS. 6 and 7.

The position of the sliding carriages 16, located at either side of the conveyor, can be adjusted both vertically and horizontally by means which have been omitted from the drawing in the interest of facilitating understanding of the invention so that the jacket wrapping apparatus may accommodate various book formats.

The sliding carriages 16 support further movable frames 24. The motion of frames 24 is under the control of pivotally mounted pneumatic actuators 25. Actuators 25 are respectively mounted on carriages 16 and engage transoms 26 which extend from cross members 24*a* of frames 24. The pivotally mounted frames 24 also each include a fixture 27 which receives a further pneumatic actuator 28.

Referring again jointly to FIGS. 2 and 3, a rotatable shaft 30 is mounted on bearings within each of frames 24. An L-shaped frame 33 is keyed to each shaft 30. Each of shafts 30 is coupled to the piston rod output member of an actuator 28 by means of a lever 34. Accordingly, the extension and retraction of the piston rod of actuators 28 will result in movement of frames 33 from the position shown in FIG. 6 to that shown in FIG. 7 and vice versa. The frames 33 have, rigidly connected to the outwardly disposed end thereof, turning bars 35.

U-shaped fixtures 36 are also mounted on the shafts 30 and are freely rotatable with respect thereto. The fixtures 36 support resistance heating elements 37. The fixtures 36 are connected to the frames 34 by means of adjustable legs 36*a* and tension springs 38. Accordingly, the heating elements will move with the turn-in bars 35 until they encounter resistance as imposed by the edges of the book cover at which time, as depicted in FIG. 7, the turning-in bars 35 will continue to move in a generally upward direction.

In operation, considering only a single side of the wrapping station, the actuator 25 will initiate the forward movement of frame 24 and thus the inward motion of the turning-in bars 35 and the heating elements 37. This action is represented as proceeding from the condition of FIG. 5 to that of FIG. 6. Thereafter, the actuator 28 will cause the rotation of shaft 30 whereby the sequence of operations depicted in proceeding from the condition of FIG. 6 to that of FIG. 7 will occur. Thus, upon energization of actuator 28, the heating elements are brought up against the edges of the cover while the turning-in bars 35 are allowed to continue their upward motion. The thermal effect upon the jacket in the area of the edges of the cover imparts the desired permanent form to the jacket due to the stretching of the paper fibers.

To insure a continuous passage of books through the jacket wrapping machine, the wrapping station is designed as a forward and reversible unit operating in the book-flow direction.

Referring again to FIGS. 1 and 4–7, the mode of operation of the disclosed embodiment of a jacket wrapping machine in accordance with the present invention is as follows. The books are fed, at intervals to one another, via the radial feeder 4 onto the conveyor. The books are split centrally by the dividing member 5 and are then delivered consecutively astride the gallows 3 of the endless conveyor which operates in the direction represented by arrows on FIG. 1. As each book is delivered to a gallows, a jacket is fed from above and placed upon the book spine. As the book proceeds through the machine the jacket is held to the spine by the endless belt 7 while the opening of both covers of the book is effected by means of opening fins 9 and angle fillets 11; the fins initially penetrating the blocks close to the edge whereupon the sheets remaining against the cover are subsequently separated therefrom due to the fact that only the edges of the cover are engaged by the angle fillets. It has been found beneficial to increase the spacing of the angle fillets 11 from the center of the conveyor in the direction of flow to offset manufacturing tolerances in the book production. The book with opened covers is transported between the guide rails 12 which, as noted above, provide a firm support for the block upon the gallows.

When the book and jacket reaches the wrapping station, the supporting rollers 10 keep the covers in the outwardly open position. At the wrapping station the rubber rollers 14 will tighten and hold the jacket upon the covers. The jacket flap portions are then wrapped around the front edges of the cover toward the inside by means of the turning-in bars 35 and the application of heat from heating elements 37. The turning back of the jacket flaps will also be affected by the motion imparted to the turning-in bars 35. Having completed the turning-in of the jacket flaps, the covers are closed upon the block. The closing is accomplished through the use of the upward and downward moving pressure rollers 40 of FIG. 1, which engage the book from above, and laterally mounted brush elements 41 which prevent a possible rebounding of the jacket flaps.

In a delivery station of the jacket wrapping machine, the books are removed from the descending gallows and deposited flat for subsequent stacking.

As will be obvious from the discussion above, there is an interdependence between the tightening of the jacket around the book spine and the opening angle imparted to the covers. Through choice of an angle other than 30°, which is within the contemplation of the present invention, the jacket will be more or less firmly conformed to the book.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A method for the application of jackets to books comprising the steps of:

opening the covers of the book outwardly from the book block to angles of approximately 30°;

depositing an unfolded jacket sheet on the book, the jacket sheet being in contact with the book in the spine region thereof intermediate the ends of the sheet;

folding edge portions of the jacket about the oppositely disposed front edges of the book cover with the aid of heat to form jacket flaps; and closing the book cover.

2. The method of claim 1 further comprising the step of:

simultaneously pulling the jacket sheet downwardly and against the opposite opened covers of the book prior to the formation of the jacket flaps.

3. The method of claim 2 wherein the step of folding the sheet to form the jacket flaps comprises:

bending the edge portions of the jacket sheet inwardly across the front edges of the covers at an angle of approximately 90° to the covers;

deflecting the inwardly bent sheet portions upwardly with respect to the covers to form flaps which at least partly extend backwardly with respect to the plane of the unfolded jacket sheet material; and simultaneously applying heat to the jacket material passing over the front edges of the covers.

4. In apparatus for the automatic application of jackets to books, said apparatus including a conveyor mechanism which transports the books along a predetermined path, the improvement comprising:

means for opening the covers of a book on the conveyor mechanism outwardly with respect to the book block;

roller means for supporting the opened covers at substantially equal predetermined angles with respect to a plane passing through the book block in a direction parallel to the block defining pages;

means for depositing an unfolded jacket sheet on the book, the jacket sheet contacting the book in the region of the spine thereof intermediate the edges of the sheet;

means for contacting and urging the jacket sheet downwardly and into contact with the covers whereby the jacket sheet will be pulled tightly over the book spine;

means for folding opposite edge portions of the jacket sheet about the front edges of the book covers to define a pair of jacket flaps; and means for heating the jacket sheet where it passes about the front edges of the book covers.

5. The apparatus of claim 4 wherein the means for opening the book covers comprises:

means for deflecting the covers outwardly with respect to the block to angles of approximately 30°.

6. The apparatus of claim 4 wherein said contacting, folding and heating means are synchronized in operation with the conveyor mechanism.

7. The apparatus of claim 4 further comprising:

first movable support means;

means mounting said folding means on said first support means for movement therewith; and means mounting said heating means on said first support means for movement therewith, said heating means also being movable independently of said first support means.

8. The apparatus of claim 7 wherein said first support means comprises:

first frame means, said first frame means being rotatable about a pivot point;

rotatable shaft means, said shaft means being mounted on said first frame means, said folding and heating means being mounted on said shaft means;

first actuator means, said first actuator means being attached to said first frame means for causing movement thereof about said pivot point; and second actuator means, said second actuator means being attached to said shaft means for imparting rotation thereto.

9. The apparatus of claim 8 wherein said folding means each comprise a longitudinal bar and wherein said folding means mounting means each comprise:

first arm means, said first arm means being affixed to said shaft means for rotation therewith and connecting said shaft means to said bar, operation of said first actuator means causing said arm means and bar to move in a first direction toward the book cover to bend the jacket sheet about the front edge of the cover, operation of said second actuator means causing rotation of said shaft means whereby said bar will move in a second direction to deflect the bent jacket sheet portion inwardly with respect to the front edge of the book cover.

10. The apparatus of claim 8 wherein said heating means are each elongated members and wherein said heating means mounting means each comprise:

second arm means, said second arm means being pivotal about said shaft means and connecting said heating member to said shaft means for movement therewith under the influence of said first and second actuator means; and means resiliently coupling said second arm means to said first frame means whereby movement of said heating member will be terminated by contact thereof with the jacket sheet passing over the front edge of the book cover.

11. The apparatus of claim 9 wherein said heating means are each elongated members and wherein said heating means mounting means each comprise:

second arm means, said second arm means being pivotal about said shaft means and connecting said heating member to said shaft means for movement therewith under the influence of said first and second actuator means; and means resiliently coupling said second arm means to said first frame means whereby movement of said heating member will be terminated by contact thereof with the jacket sheet passing over the front edge of the book cover.

12. The apparatus of claim 11 wherein the means for opening the book covers comprises:

means for deflecting the covers outwardly with respect to the block to angles of approximately 30°.

13. The apparatus of claim 4 further comprising:

means for pressing the unfolded jacket sheet against the book in the region of the spine thereof during the downwardly urging, folding and heating thereof.

14. The apparatus of claim 12 further comprising:

means for pressing the unfolded jacket sheet against the book in the region of the spine thereof during the downwardly urging, folding and heating thereof.

15. The apparatus of claim 4 further comprising:

supporting fillets for engaging the edges of the opened book covers prior to engagement thereof by said roller means, said fillet diverging in the direction of motion of the book.

16. The apparatus of claim 12 further comprising:

supporting fillets for engaging the edges of the opened book covers prior to engagement thereof by said roller means, said fillet diverging in the direction of motion of the book.

17. The apparatus of claim 14 further comprising:

supporting fillets for engaging the edges of the opened book covers prior to engagement thereof by said roller means, said fillet diverging in the direction of motion of the book.

* * * * *